United States Patent [19]

Panetti

[11] 4,189,873

[45] Feb. 26, 1980

[54] MACHINE FOR TRUING THE BEARING SURFACE OF THE RAILS OF A RAILROAD TRACK

[75] Inventor: Romolo Panetti, Geneva, Switzerland

[73] Assignees: Speno International S.A., Geneva, Switzerland; Frank Speno Railroad Ballast Cleaning Co. Inc., East Syracuse, N.Y.

[21] Appl. No.: 856,767

[22] Filed: Nov. 29, 1977

Related U.S. Application Data

[63] Continuation of Ser. No. 645,472, Dec. 30, 1975, abandoned.

[30] Foreign Application Priority Data

Feb. 25, 1975 [CH] Switzerland ..... 002372/75

[51] Int. Cl.[2] ..... B24B 23/00

[52] U.S. Cl. ..... 51/178

[58] Field of Search ..... 51/178

[56] References Cited

U.S. PATENT DOCUMENTS

| | | | |
|---|---|---|---|
| 3,707,808 | 1/1973 | Danko et al. | 51/178 |
| 3,738,066 | 6/1973 | Panetti | 51/178 |

FOREIGN PATENT DOCUMENTS

| | | | |
|---|---|---|---|
| 1060027 | 11/1953 | France | 51/178 |

*Primary Examiner*—James L. Jones, Jr.

*Attorney, Agent, or Firm*—Haseltine, Lake & Waters

[57] ABSTRACT

A machine for truing the bearing surface of the rails of a railroad track which is movable over the rails to be trued comprising a frame on which is mounted a train of grinding elements to be driven one behind the other over and along the rails tangentially of the bearing surface to remove irregularities. The machine is characterized in that at least one of the grinding elements can be displaced in a direction toward or away from the bearing surface of the rail to be trued to reach a desired position and can be locked into this desired position.

2 Claims, 8 Drawing Figures

MACHINE FOR TRUING THE BEARING SURFACE OF THE RAILS OF A RAILROAD TRACK

This Application is a continuation of Ser. No. 645,472 filed Dec. 30, 1975 now abandoned.

FIELD OF THE INVENTION

The present invention relates to a machine for truing the bearing surface of a rail of an existing railroad track, which machine has a frame movable over the rail, to which frame is mounted a train of grinding elements to be driven one behind the other over and along the rail to be trued tangentially of its bearing surface.

BACKGROUND

Repeated passage of heavier and faster train convoys produces wear and cold rolling of the bearing surface of the rails thus causing the formation of undulations of varying lengths on the said bearing surface. This defect is remedied by truing the heads of installed track rails by means of several grinding elements optionally working in association with other contact elements, such as shoes or rollers, and forming a train driven as mentioned above, the use of a single abrading element not being sufficient to correctly and rapidly true the extensive lengths of tracks actually in service.

Two types of suspension of such contact elements have so far been used. The first type is the individual suspension, one for each contact element, the other is the suspension of several rigidly associated contact elements, optionally grouped.

The first of the above-mentioned types of suspension has the inconvenience that the contact elements, particularly the grinding elements, follow the section of the rail provided the length of the undulations is sufficient to allow the elements to dip into them whereas, in the second type, rigid groups are provided of a length such that their contact elements straddle the long undulations, making it possible for the grinding elements to restore a rectilinear section by grinding the crests. This is however only correct for a rectilinear rail whose bearing surface lies in a plane.

When a straight track presents a change in slope connected by a curve, it has a convex or concave curvature, that is a dip or a hump, or else when a track curves which, because of the inclination resulting from banking, has the effect of giving its hearing surface a conical shape, it is obvious that a series of abrading elements whose the points of contact are located in a common plane will not be able to correctly effect a proper truing operation.

SUMMARY OF THE INVENTION

In order to overcome the above drawback, the present invention provides that at least one of the contact elements may be displaced in a direction drawing it closer to or moving it away from the installed rail to be trued and is associated with means to lock it in either one or the other of the acquired positions.

As will easily be gathered, this makes it possible fixedly to adjust the position of the contact elements, particularly the grinding elements, to any radius of curvature of the rail caused by a change of slope or by a curve of a given radius whereby to machine such track portions with grinding elements appropriately positioned as is the case with the alignment corresponding to straight line machining.

With the above objects in view, the invention more specifically contemplates to a machine for truing the bearing surface of a rail of a railroad track, the machine having a frame movable over the rail, to which frame is mounted a train of abrading or grinding elements to be driven one behind the other and along the rail tangentially of its bearing surface to remove irregularities thereover. The machine is characterized in that it comprises means to move at least one of the grinding elements in the direction of the bearing surface to reach a predetermined position relative thereto and means to lock such grinding elements in the said predetermined position.

BRIEF DESCRIPTION OF THE DRAWING

Reference will now be made to the appended drawings illustrating several specific embodiments of the invention, wherein.

DETAILED DESCRIPTION

Figure 1:
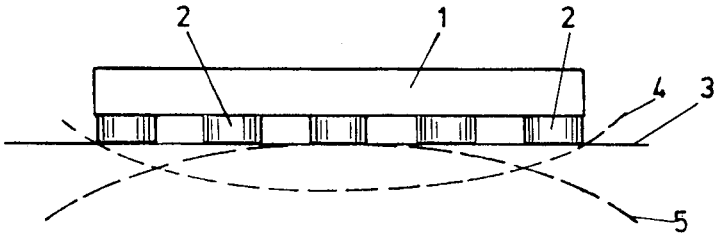
FIG. 1 is a diagrammatic illustrations intended to illustrate the principle of the invention.

FIG. 1 illustrates, in an exaggerated manner, a situation where the machine of the invention is to be used. As shown, a series of grinders 2, five for instance, are mounted on a common carrier frame 1, the grinders being secured so that their respective working surfaces lie in a common plane corresponding to that of the bearing surface of the head of a rectilinear rail, diagrammatically shown by line 3, and having no change in slope.

It is obvious that when such a change in slope occurs, only the extreme grinders of the illustrated train of grinders will touch the rail in the case of a dip 4 of the rail or only one of the grinders will do so in the case of a hump 5.

The same situation prevails if some of the grinders or other abrading elements, for example 2, are to be replaced by other contact elements, such for instance as shoes or rollers. If such elements replace the two end grinders, it can be seen that no truing work can be done if the rail defines a dip 4.

Figure 2:
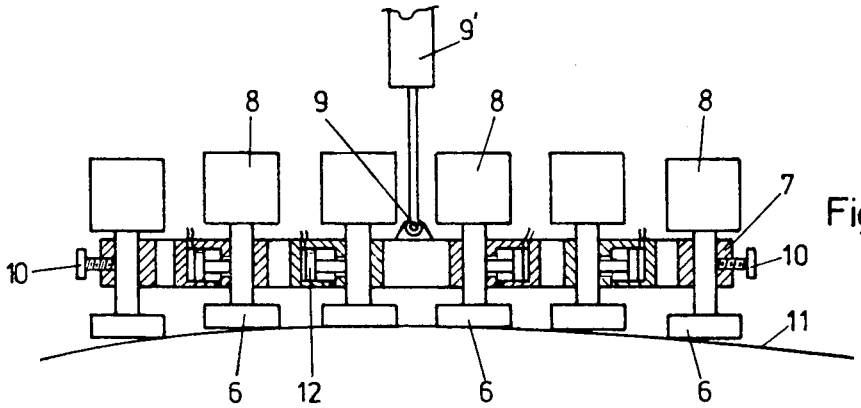
FIGS. 2 to 8 are diagrammatic illustrations each illustrating a specific embodiment with the exception of FIGS. 3 ad 4 both showing the same embodiment in two different positions.

Referring now to the embodiment illustrated in FIG. 2, the abrading elements therein are constituted by six grinders 6 supported by a common frame 7, each grinder having an independent motor 8.

The frame, which oscillates about a pivot 9, may be brought closer to or moved away from the rail by means of a jack 9', thereby making it possible to adjust the pressure exerted by the assembly on the rail.

With respect to the frame 7, each motor-grinder unit may slide independently in the direction of the rail.

In the above case, it is assumed that the two end units are fixed in a predetermined position by locking screws 10 whereas the others are not, at least at the time a change in slope is met.

This change in slope is illustrated by the curvature 11 of the rail defining a hump of predetermined and continuous radius.

The end grinders bearing against the rail and fixed with respect to the frame 7, the hump of the rail raises the other four grinders, as shown, that is in such a way that the six grinders rest substantially over the bearing surface to be trued.

Once these positions are reached, all of the units are fixed by an individual pneumatic or hydraulic locking device such as shown at 12 which locking device comprises a piston applied against the bearing connecting the motor to the grinder of the unit being considered.

Once such locking is achieved, the rail is ground and the irregularities trued as in the case of a rectilinear track.

It is obvious that by so locking all of the grinders at the same height, this arrangement, as well as those to be described hereinafter, are useful also in the truing of rectilinear tracks.

Figure 3:
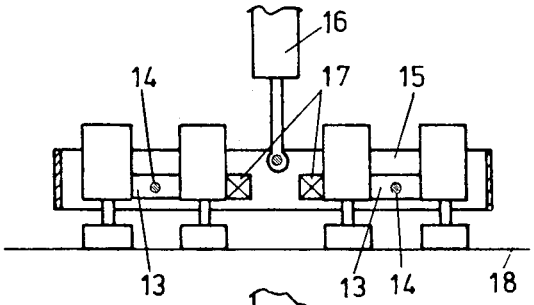
Figure 4:
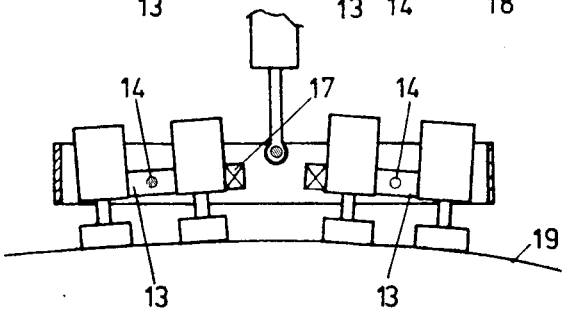

In the second embodiment illustrated in FIGS. 3 and 4, four grinding units are provided carried two by two, preferably balanced, by two beams 13 oscillating about pivots 14 of a frame 15, each beam carrying a pair of units. As before, a jack 16 provides for the articulated raising or lowering of the assembly.

Locking devices allow fixing of the beams 13 in any desired position.

FIG. 3 illustrates the assembly moving along a rectilinear track 18 and FIG. 4 along a hump of the track 19 defining a change in slope.

It is easy to see that, to move from one case to the other, the beams 13 oscillate in such a way as always to ensure proper application of the four grinders on the bearing surface of the rail to be trued.

As in the preceding case, the locking means 17 are used at the proper time.

Figure 5:
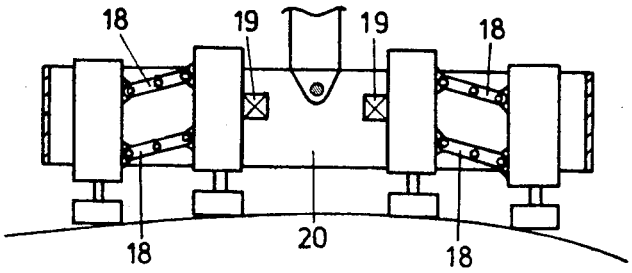

Another embodiment using four grinders, divided into two groups of two grinding units each is illustrated in FIG. 5.

Here, the units of each pair are interconnected by oscillating levers 18 forming parallelogram linkages articulated to the units they interconnect.

The corresponding locking means are illustrated at 19. This embodiment is the same as the preceding one with the difference that the motor-grinder axes are always perpendicular to the carrier frame 20 so that the grinders do not apply flatly over the bearing surface to be trued, as in the preceding embodiment where these axes bend, particularly converging toward the center of curvature of the illustrated hump.

On the other hand, reference has not exclusively been made to grinders but to contact elements which can comprise other members.

Figure 6:
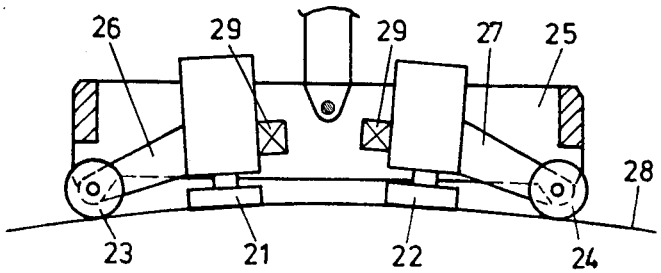

That is the situation in the next embodiment illustrated in FIG. 6. In this embodiment, two grinders 21, 22 are disposed between two rollers 23, 24 pivoted at the ends of a frame 25. Each of the corresponding pivots simultaneously serves as the axis of rotation for levers 26 and 27. Lever 26, oscillating about the axis of the roller 23, carries the grinder 21 and its motor whereas lever 27, oscillating about the axis of the opposed roller 24 carries the other grinding unit 22.

This freedom of movement makes it possible to ensure, during movement over a hump 28, a perfect contact of the rollers and of the grinders with the bearing surface to be trued.

As in the previous embodiments, the working position may be secured by locking means 29.

Figure 7:
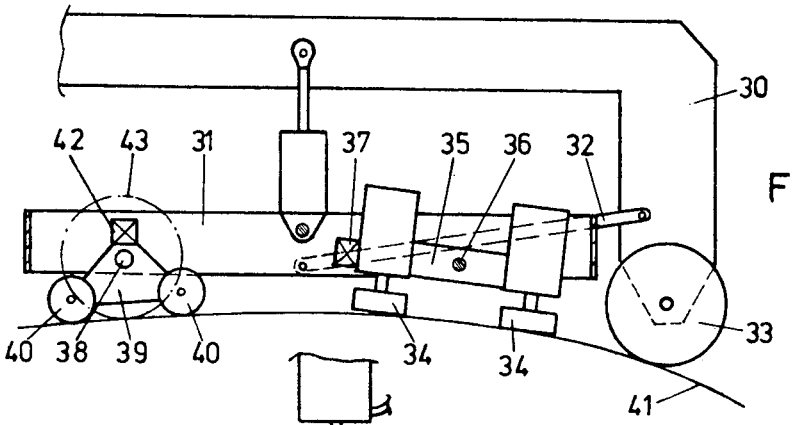

The next embodiment shown in FIG. 7 likewise comprises grinders associated with roller elements.

A vehicle carrying the various members is shown at 30, the members themselves being carried by a frame 31. The latter is connected to the frame 30 by means of a link 32 so that the frame may bank at will. The vehicle 30 is mounted by an axle on wheels 33 as shown at 33.

Two grinders 34 are shown at one end of the frame 31, the grinders being supported by a beam 35 pivoted at 36 and acting exactly like the one illustrated in FIGS. 3 and 4, the locking means being shown at 37.

At the other end of the frame 31, there is provided a pivot 38 which acts as a center of rotation for a triangular plate 39 carrying two rollers 40.

As with the pair of grinders 34 pivoting with its beam 35, this pair of rollers 40, pivoting with its plate 39, bears against the curvature of the track 41. A locking means 42 makes it possible to fix the plate 39 with respect to the frame 31.

It is obvious that the two rollers 40 could be replaced by a second wheel 43 illustrated in broken lines. In the latter case, only the locking means 37 of the grinders 34 is necessary.

Figure 8:
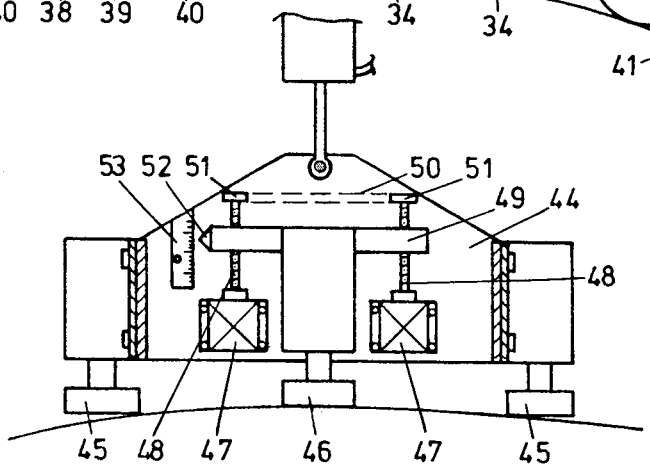

The grinders or other contact elements have so far been allowed to take on their working position simply by letting them bear against the rail. But it would likewise be possible to force them into relative positions as a function of a predetermined curvature. This is what has been done in the embodiment shown in FIG. 8.

Here, the frame 44 carries at each of its ends a grinder having a rigidly fixed position.

A third grinder 46 is provided between the two grinders 45, this grinder 46 being capable of being raised or lowered at will whereby to obtain, with the two first grinders, three points of contact located on a curve to be trued.

Two auxiliary motors 47 secured to the frame 44 simultaneously actuate two screws 48 acting on a transverse support 49 of the grinding unit. A chain 50 and sprocket wheels 51 ensure even rotation of the two screws and thereby displacement of the support 49 parallel to itself.

A finger 52 of support 49 and a scale 53 of the frame 44 make it possible, with an appropriate division of the scale, to determine, according to the position of the finger, the positive or negative radius of curvature which corresponds to the position of the central grinder 46. The screws 48 in themselves ensure the desired locking action.

All of the above embodiments have been described with respect to a hump in the track but it is obvious that the same holds true in the case of a dip.

In sum, the arrangement according to the invention makes it possible always to carry out the machining work with a series of grinders that are appropriately applied over the rail, whether the track be rectilinearly flat, whether it forms a hump or a dip of given radius following a variation in level, or whether it defines a curve of given radius. The constancy of the applied force may also and without difficulties be controlled during the operation, for instance, by providing each individual motor of each grinder with an ammeter which makes it possible to observe the value of the force applied.

Finally, it is possible to provide for pivoting of the carrying frame by 90° in the transverse direction in order to be able to grind the inside of the rail head.

The embodiments of the invention in which an exclusive property or privilege is claimed:

1. A machine for truing the bearing surface of a rail of a railroad track, said machine comprising a frame movable over the rail, a train of contact elements coupled to said frame for being driven one behind the other over and along said rail tangentially of said bearing surface with said contact elements in contact with said rail, said contact elements each comprising a grinding means for truing the bearing surface of the rail, support means supporting said contact elements for movement relative to the frame in the direction of said bearing surface to permit said contact elements to reach a predetermined position relative to the rail as the frame moves over the rail, and locking means for locking said contact elements in said predetermined position, said train of contact elements comprising two groups each of two contact elements, a pair of beams and means mounting said groups on said beams, respectively, said support means including pivot means supporting the beams on said frame for pivotal movement thereof about axes located between the contact elements of said groups, said locking means comprising hydraulic cylinder means for locking a respective said beam and the contact elements thereon with respect to said frame, jack means acting on said frame for urging all the contact elements uniformly with greater or lesser force against the rail, said jack means comprising a jack connected to said frame midway between said beams, each contact element comprising an associated drive means coupled therewith.

2. A machine as claimed in claim 1 wherein said contact elements project below said frame and constitute the only means by which the frame rests on the rail.

* * * * *